US010544809B2

(12) United States Patent
Neel et al.

(10) Patent No.: US 10,544,809 B2
(45) Date of Patent: Jan. 28, 2020

(54) DRY ROUGHING VACUUM PUMP

(71) Applicant: PFEIFFER VACUUM, Annecy (FR)

(72) Inventors: Thierry Neel, Meythet (FR); Serge Brandolin, Annecy (FR)

(73) Assignee: PFEIFFER VACUUM, Annecy (FR)

( * ) Notice: Subject to any disclaimer, the term of this patent is extended or adjusted under 35 U.S.C. 154(b) by 533 days.

(21) Appl. No.: 14/902,042

(22) PCT Filed: Jul. 3, 2014

(86) PCT No.: PCT/EP2014/064259

§ 371 (c)(1),
(2) Date: Dec. 30, 2015

(87) PCT Pub. No.: WO2015/001059

PCT Pub. Date: Jan. 8, 2015

(65) Prior Publication Data

US 2016/0369820 A1 Dec. 22, 2016

(30) Foreign Application Priority Data

Jul. 4, 2013 (FR) ..... 13 56534

(51) Int. Cl.
*F04F 5/46* (2006.01)
*F04F 5/54* (2006.01)
(Continued)

(52) U.S. Cl.
CPC ..... *F04F 5/461* (2013.01); *F04F 5/20* (2013.01); *F04F 5/48* (2013.01); *F04F 5/54* (2013.01)

(58) Field of Classification Search
CPC .... F04B 37/14; F04B 39/0027; F04B 39/055; F04B 39/0061; F04B 49/22; F04B 49/225;
(Continued)

(56) References Cited

U.S. PATENT DOCUMENTS 401,753 A * 4/1889 Lombard ..... F04F 5/32 417/193
1,032,222 A * 7/1912 Looke ..... F04F 5/32 417/193
(Continued)

FOREIGN PATENT DOCUMENTS

DE 100 36 045 C1 10/2001
DE 10 2007 005 488 A1 6/2008
(Continued)

OTHER PUBLICATIONS

International Search Report of PCT/EP2014/064259, dated Sep. 17, 2014. [PCT/ISA/210].
(Continued)

*Primary Examiner* — Bryan M Lettman
*Assistant Examiner* — Charles W Nichols
(74) *Attorney, Agent, or Firm* — Sughrue Mion, PLLC

(57) ABSTRACT

A dry roughing vacuum pump includes a valve (10; 15) with a through-passage arranged in the discharge line (9), the valve (10) with a through-passage being able to move between a closed position in which the valve (10; 15) with a through-passage is in contact with a seat of a mouth (12) of the discharge line (9) and an open position in which the valve with a through-passage is moved away from the mouth (12) of the discharge line (9), the vacuum pump including a motor gas injection device (13) that is configured to inject a motor gas into the inlet (11*a*) of the Venturi-effect passage (11).

16 Claims, 5 Drawing Sheets

(51) Int. Cl.
*F04F 5/20* (2006.01)
*F04F 5/48* (2006.01)

(58) Field of Classification Search
CPC ..... F04B 49/03; F04B 49/08; F04B 53/10; F04C 25/02; F04C 28/24; F04C 2270/18; F04C 2270/185; F04C 2270/44; F04C 2270/58; F04C 2270/585; F04F 5/14; F04F 5/16; F04F 5/20; F04F 5/22; F04F 5/30; F04F 5/461; F04F 5/465; F04F 5/48; F04F 5/54; Y10T 137/7847
USPC ..... 137/513.3
See application file for complete search history.

(56) References Cited

U.S. PATENT DOCUMENTS 2,767,727 A * 10/1956 Acomb ..... A61M 16/00 128/204.25
4,505,645 A * 3/1985 Laguilharre ..... F04B 23/12 417/69
4,860,795 A 8/1989 Oten
5,024,583 A * 6/1991 Sasaki ..... F02M 37/025 417/194
5,323,773 A * 6/1994 Kobayashi ..... A62B 9/02 128/205.24
5,758,691 A * 6/1998 Nedderman, Jr. .... B01F 5/0413 137/893
6,270,321 B1 8/2001 Schulte
2005/0019169 A1* 1/2005 Kriehn ..... F04C 18/086 417/53
2008/0149868 A1 6/2008 Bittner et al.
2013/0156610 A1* 6/2013 Gregor ..... F04B 7/00 417/53

FOREIGN PATENT DOCUMENTS

EP 0 974 010 B1 12/2001
EP 1 609 990 A1 12/2005
FR 2 952 683 A1 5/2011

OTHER PUBLICATIONS

Written Opinion of PCT/EP2014/064259, dated Sep. 17, 2014. [PCT/ISA/237].

* cited by examiner

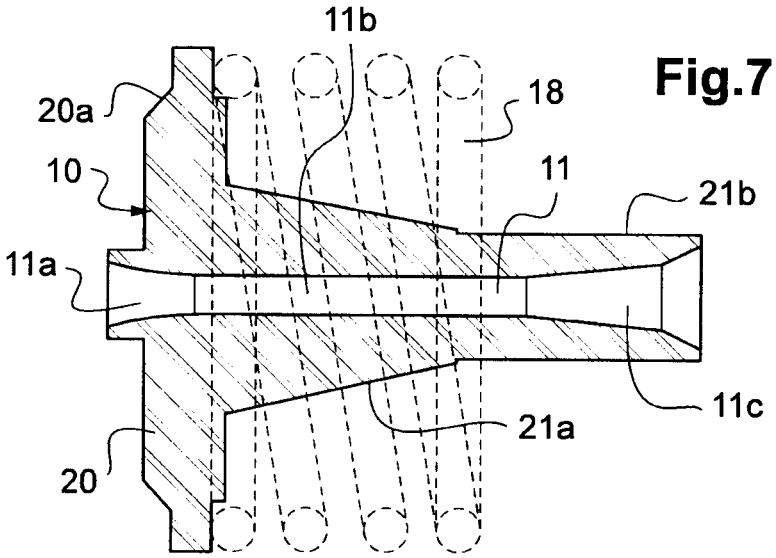
Fig.7
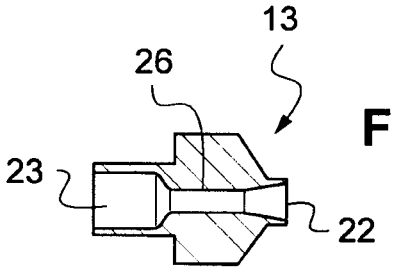
Fig.8
Fig.9
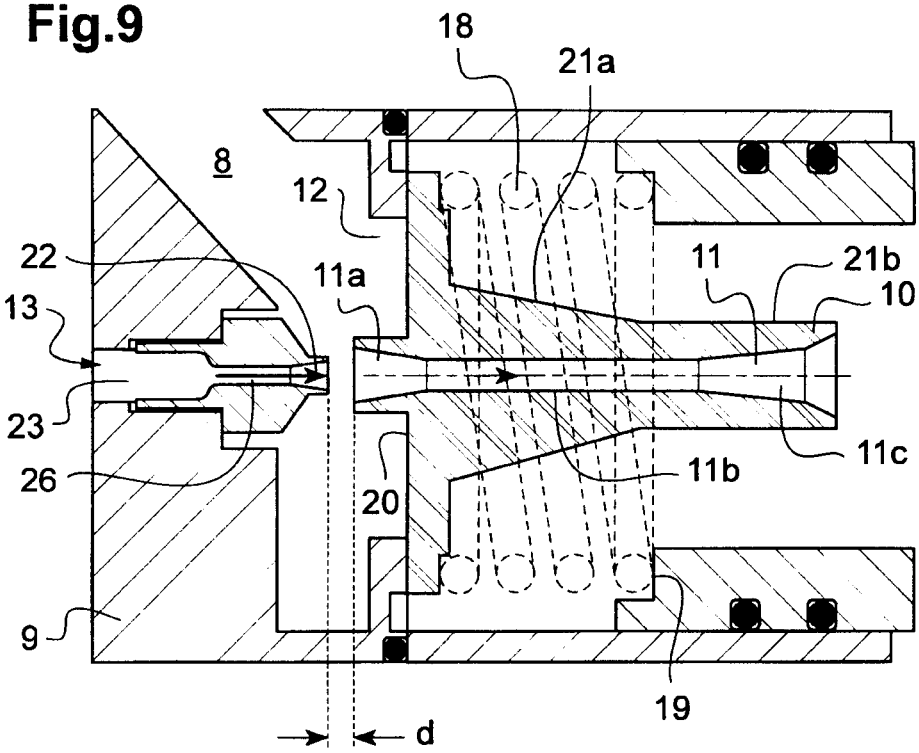

DRY ROUGHING VACUUM PUMP

CROSS REFERENCE TO RELATED APPLICATIONS

This application is a National Stage of International Application No. PCT/EP2014/064259 filed Jul. 3, 2014, claiming priority based on French Patent Application No. 1356534, filed Jul. 4, 2013, the contents of all of which are incorporated herein by reference in their entirety.

BACKGROUND OF THE INVENTION

The present invention relates to a dry roughing vacuum pump that allows electrical power consumption to be reduced. It relates in particular to roughing vacuum pumps of the "dry rotary lobe pump" type, such as lobe pumps of the "roots" type, claw pumps, scroll pumps, screw pumps, piston pumps, etc., in a single-stage or multi-stage version.

The electrical power needed for compressing gases is one of the significant parameters involved in the power consumption of dry roughing vacuum pumps. This compression power is used mainly in the last two compression stages in the case of a multi-stage pump of the roots or claw type, and in the last flights in the case of a screw pump.

In order to reduce the electrical power consumption of the roughing vacuum pump, one known solution is to lower the pressure in the final compression stage using an ejector. The ejector operates on the principle of the Venturi effect. It means that a drop in pressure can be obtained from the injection of a compressed fluid, such as a gas like nitrogen or compressed air for example, at a narrowing of the passage for the gases. A depression is thus created without any direct consumption of electrical power.

However, positioning the ejector in the discharge line reduces the conductance for the passage of the pumped gases so that significant flows of gas that occur, for example, when roughing a vacuum in the chamber, can no longer be absorbed.

A solution known from document FR 2952683, is to mount the ejector in a parallel circuit, arranged to bypass the nonreturn valve. Thus, when the nonreturn valve is closed, the gas follows the bypass circuit in which the ejector is mounted. The injection of motor gas into the narrowing of the bypass circuit produces a lowering of the pressure on the discharge side and therefore a drop in the consumed power. Further, in the event of a surplus of gas, the nonreturn valve opens, short-circuiting the parallel circuit.

SUMMARY OF THE INVENTION

It is one of the objects of the present invention to propose a simplified vacuum pump, that is more robust, more compact, less expensive to produce and easier to maintain than that of the prior art.

To this end, one subject of the invention is a dry roughing vacuum pump comprising at least one pumping stage for pumping gases from an inlet to an outlet, a discharge line connected to the outlet of the last pumping stage, characterized in that a valve with a through-passage is arranged in the discharge line, the said valve with a through-passage being able to move between:

- a closed position in which the said valve with a through-passage is in contact with a seat of a mouth of the discharge line and forces the gases to pass through a Venturi-effect passage that passes through the valve with a through-passage, and

- an open position in which the said valve with a through-passage is moved away from the mouth of the discharge line, the said valve with a through-passage being in the open position when the outlet pressure of the pumping stage is above a predetermined pressure threshold,
- the vacuum pump comprising a device for injecting motor gas which is configured to inject a motor gas into the inlet of the Venturi-effect passage so that that in the closed position the Venturi-effect passage forms an ejector with the motor-gas injection device when a motor gas is injected into the inlet of the Venturi-effect passage.

The valve with a through-passage thus forms both an ejector, when in the closed position for generating the Venturi effect when a motor gas is injected upstream of the Venturi-effect passage, and an automatic discharge circuit, when in the open position, to bypass the Venturi-effect passage in the event of surplus gas.

The injection of motor gas into the inlet of the Venturi-effect passage of the valve with a through-passage uses the Venturi effect to lower the pressure at the outlet of the final pumping stage of the vacuum pump.

The absolute pressure obtained at the outlet of the final pumping stage is therefore lowered to a pressure of the order of 100 to 400 mbar rather than 1000 mbar.

This lowering of the output pressure leads to a reduction in the consumption of electrical power of the order of 30 to 70% without adversely affecting the pumping performance (flow of gas as a function of pressure).

The lowering of the electrical power consumption also leads to a lowering of the temperature of the pump housing such that the amount of heat energy to be removed is lower and may lead to a reduction in the consumption of cooling water.

Furthermore, the lowering of the pressure at the outlet of the final pumping stage means that the pumping conditions can be kept further away from the flammability and explosion limits and the partial pressures of condensable and/or corrosive species can be reduced, thereby significantly reducing the risks of corrosion on the materials of the vacuum pump and the risk of plugging with condensate.

Also, the lowering of the pressure at the outlet of the final pumping stage reduces the level of noise created by the vacuum pump. This is because the depression lessens the intensity of the low-frequency pulsation of the final pumping stage.

Furthermore, the gases have an automatic discharge circuit available which is created by the valve with a through-passage moving into the open position in the event of a high pump flow, such that the narrowing formed by the Venturi-effect passage does not form an obstacle to the pumping of significant flows of gas. There is therefore no need to machine a parallel bypass circuit into the pump housing and/or to arrange an external bypass circuit with a controlled valve, which means that the vacuum pump is simplified, more compact, and also more robust and easier to maintain.

According to one embodiment, the Venturi-effect passage is in the shape of a nozzle with a narrowing. For example, the inlet of the nozzle is shaped like a funnel, the neck of which is extended by a cylindrical central portion and ends in a flared shape. The nozzle then has a shape that is optimized for generating a significant drop in pressure.

The head of the valve with a through-passage for example has a guiding shape configured to collaborate with a complementary guiding shape belonging to the mouth. The complementary guiding shapes are, for example, frustoconical or partially spherical. The complementary guiding shapes make it possible to provide sealing and ensure correct positioning of the valve with a through-passage each time it returns to the closed position, thus making it possible to ensure optimal operation as an ejector using the Venturi effect.

According to a first embodiment, the valve with a through-passage is positioned at the inlet to a silencer of the vacuum pump.

The motor gas injection device is, for example, in part incorporated into the pump body of the vacuum pump.

The assembly forming valve and ejector is thus arranged at the very heart of the vacuum pump and can therefore benefit from the high temperature of the pump housing during operation for heating it up. As a result, by heating the valve with a through-passage notably by conduction with the heated pump housing, the risks of plugging of the Venturi-effect passage that may arise, caused by the cooling of the condensable gases brought about by the expansion of the gas in the Venturi-effect passage, can be reduced.

According to a second example, the valve with a through-passage is arranged at one end of the discharge line, the end being connected to a pumped gases treatment device. The discharge line is then kept under low pressure from the outlet of the gases from the final pumping stage as far as the inlet to the gas treatment device, a journey which may represent several metres of piping. The fact that the discharge line is kept at low pressure means the condensable gaseous species can be kept in gaseous form, something which may make it possible to avoid the need to heat the discharge line.

The motor gas injection device may comprise a supply line, one end of which bears an injection nozzle, the motor gas injection axis and the axis of the Venturi-effect passage being aligned.

The vacuum pump may further comprise an elastic return element for urging the said valve with a through-passage into the closed position. The elastic return element is, for example, interposed between a head of the valve with a through-passage and an annular shoulder of the discharge line, downstream of the mouth in the direction in which the pumped gases flow.

According to another embodiment, the valve with a through-passage is arranged vertically above the mouth. The valve with a through-passage can then be urged under gravity towards the position in which it is closed against the mouth.

According to a first embodiment, the Venturi-effect passage is formed in the said valve with a through-passage.

Furthermore, provision may be made for the motor gas injection device to be mobile. The device for injecting the motor gas is then secured to the valve with a through-passage with a fixed predetermined distance between the outlet of the motor gas injection device and the inlet of the Venturi-effect passage, at least one pumped gases inlet orifice being formed between the outlet of the motor gas injection device and the inlet of the Venturi-effect passage.

Joined together in this way, the distance between the outlet of the motor gas injection device and the inlet of the Venturi-effect passage is fully controlled. There is therefore certainty that correct centring and correct positioning of the valve with a through-passage with respect to the injection of motor gas for obtaining the Venturi effect will be maintained.

The vacuum pump may further comprise an elastic return member interposed between the vacuum pump body and the motor gas injection device to urge the valve with a through-passage into the open position. This then improves the guidance and positioning of the motor gas injection device.

The valve with a through-passage has, for example, a stem extending the head, the stem having an exterior shape that progressively tapers radially at least partially from the head. This tapering shape makes it possible to lessen the turbulence that may be generated nearby in the gaseous stream and makes it possible progressively to stabilize the flow of gases around its profile, thus minimizing any oscillation of the valve with a through-passage. It is also suited, where appropriate, to being inserted at the inlet to the silencer of the vacuum pump without blocking the passage but leaving open an annular opening that is compatible with a high flow rate when the valve with a through-passage is in the open position.

According to a second embodiment, the Venturi-effect passage is formed in a protrusion secured to the motor gas injection device with a fixed predetermined distance between the outlet of the motor gas injection device and the inlet of the Venturi-effect passage, at least one pumped gases inlet orifice being formed between the outlet of the motor gas injection device and the inlet of the Venturi-effect passage. The protrusion collaborates with an additional seat formed in an opening in the valve for the through-passage.

Thus the distance between the outlet of the motor gas injection device and the inlet of the Venturi-effect passage is fully controlled. There is therefore certainty that correct centring and correct positioning of the valve with a through-passage with respect to the injection of motor gas for obtaining the Venturi effect can be maintained.

To make it easier for the valve with a through-passage to centre itself on the protrusion, the protrusion and the additional seat formed in the opening of the valve with a through-passage may have complementary guiding shapes, such as frustoconical or partially spherical shapes.

BRIEF DESCRIPTION OF THE DRAWINGS

Further advantages and features will become apparent from reading the description of an illustrative but nonlimiting embodiment of the present invention, and from the attached drawings in which:

FIG. 7 depicts a view in cross section of a valve with a through-passage and of a spring, assembled, FIG. 8 depicts a view in cross section of a supply line of a motor gas injection device, FIG. 9 depicts a partial view in cross section of the valve-ejector assembly in a dry roughing vacuum pump according to another embodiment.

DETAILED DESCRIPTION OF THE INVENTION

The invention relates to a dry roughing vacuum pump intended for pumping out a chamber such as a process chamber, intended for example for the manufacture of substrates in the semiconductor, LED, flat screen or solar panel industry.

The dry roughing vacuum pump is for example of the "rotary lobes" type, such as a "root" pump, a claw pump, a scroll pump, a screw pump, a piston pump or a pump working on some other similar principle, in a single-stage or multi-stage version.

Figure 1:
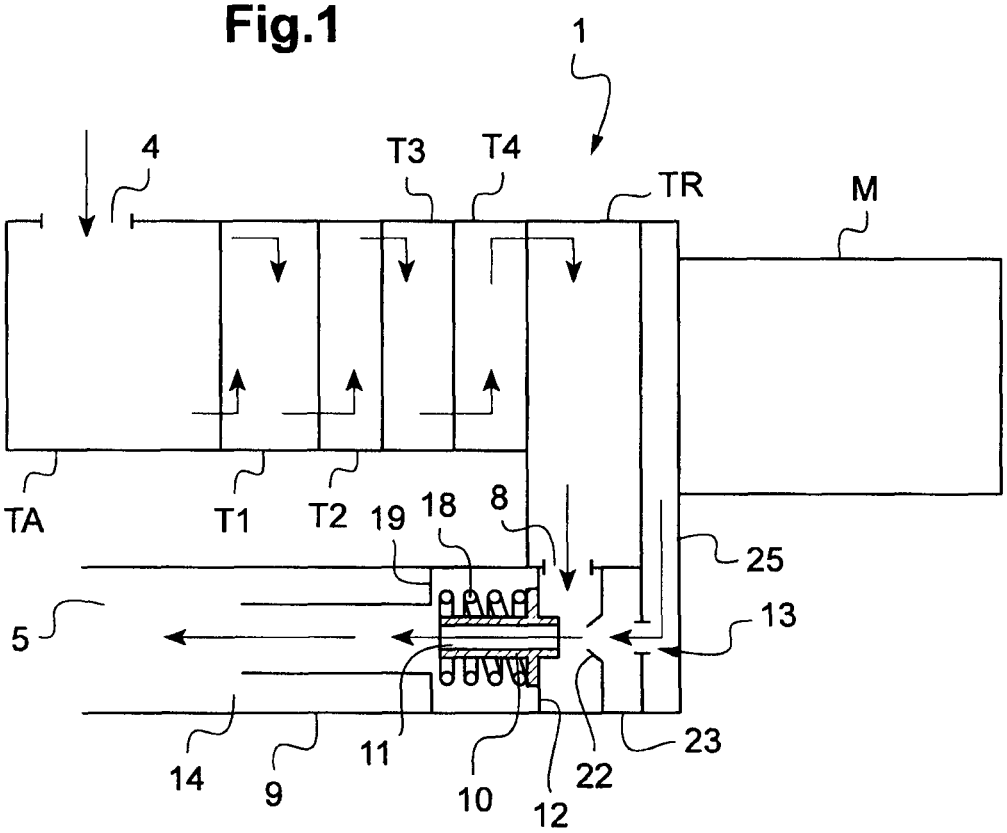
FIG. 1 depicts a schematic view of a dry roughing vacuum pump with the valve with a through-passage in the closed position.
Figure 2:
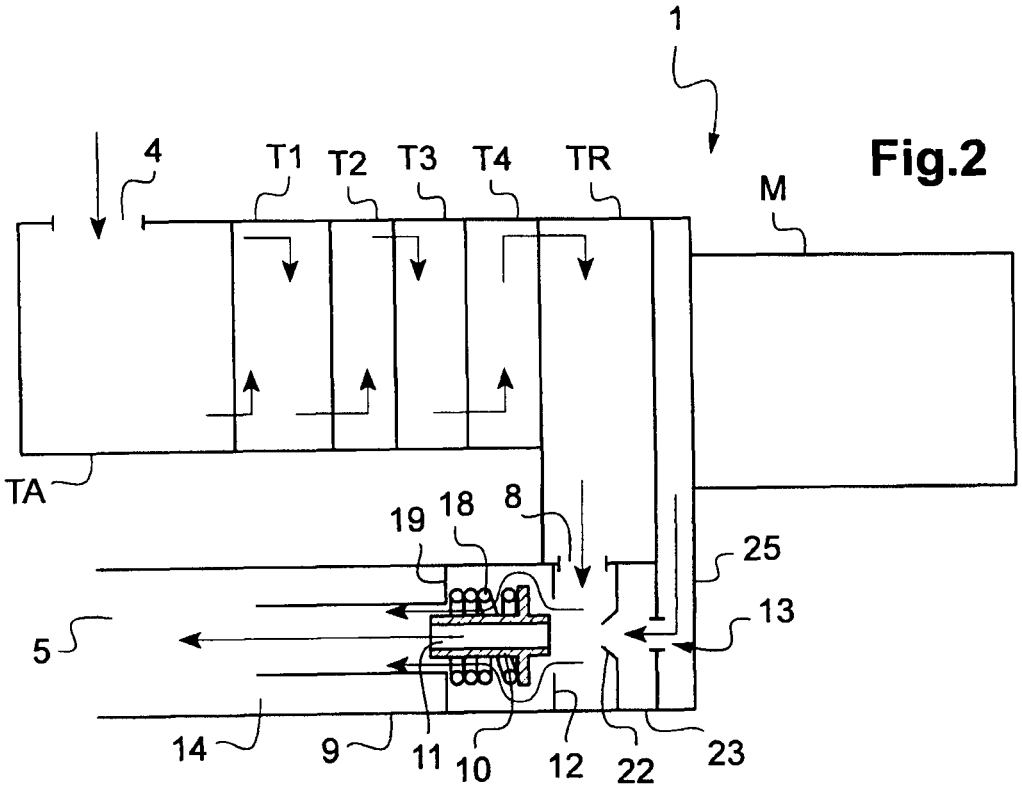
FIG. 2 depicts a view similar to FIG. 1, with the valve with a through-passage in an open position.
Figure 3:
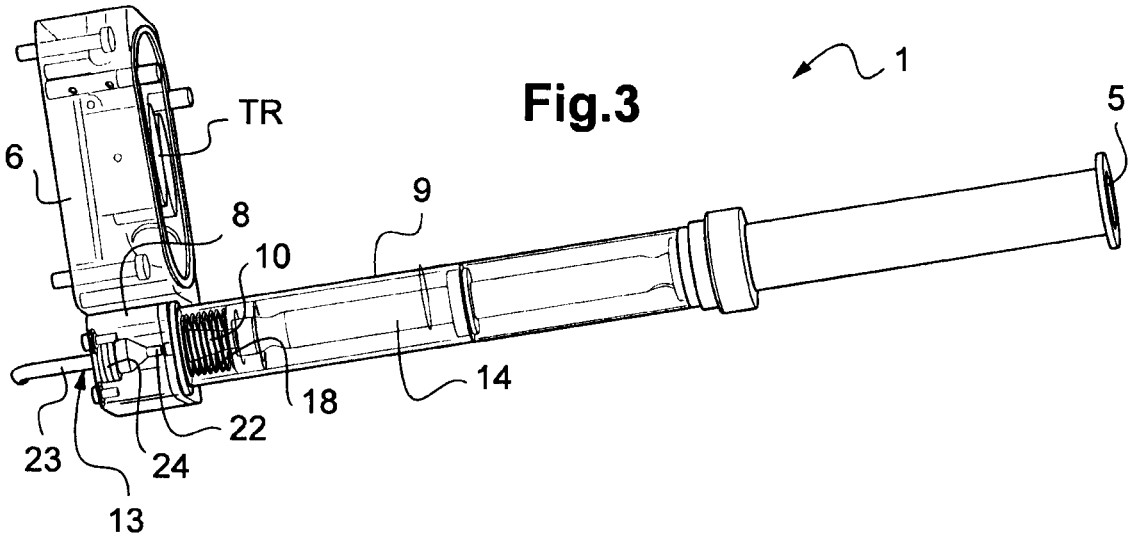
FIG. 3 depicts a portion of the final pumping stage and of a discharge line of a dry roughing vacuum pump with some of the components shown as hidden detail.

In the example illustrated in FIGS. 1 and 2, the dry roughing vacuum pump 1 is a multi-stage pump. It comprises, for example, six pumping stages TA, T1, T2, T3, T4, TR, mounted in series between an intake 4 and a discharge 5 of the vacuum pump 1 and through which a gas that is to be pumped can circulate from the intake 4 to the discharge 5, the discharge pressure 5 being generally of the order of atmospheric pressure.

Within the pump stages TA, T1, T2, T3, T4, TR, rotary shafts extend in the form of rotors and are driven on the discharge stage TR end by a motor M of the vacuum pump 1. The rotors have mating or complementing profiles, rotating inside the pump housing 6 in opposite directions. Upon rotation, the gas that is to be pumped becomes trapped between the empty space comprised between the rotors and the pump housing 6, and is driven by the rotors toward the next stage or toward the discharge 5 after the final pumping stage TR. The vacuum pump 1 is said to be "dry" because, in operation, the rotors rotate inside the pump housing 6 of the vacuum pump 1 in opposite directions, with no mechanical contact between the rotors and the pump housing 6, thus allowing there to be a complete absence of oil in the pumping stages TA, T1, T2, T3, T4, TR, in contrast with vacuum pumps referred to as lubricated vane pumps.

Each pumping stage TA, T1, T2, T3, T4, TR comprises a respective inlet and outlet. The successive pumping stages TA, T1, T2, T3, T4, TR are connected in series one after another by respective outlet lines, also referred to as inter-stage lines, which connect the outlet of the preceding pumping stage to the inlet of the next stage (refer to the arrows in solid line in FIG. 1). The first pumping stage TA, the inlet of which communicates with the intake 4 of the vacuum pump 1, is also referred to as the "intake stage". The final pumping stage TR, the outlet 8 of which communicates with the discharge 5 of the vacuum pump 1, is also referred to as the "discharge stage", the discharge pressure generally being of the order of atmospheric pressure.

The vacuum pump 1 further comprises a discharge line 9 connecting the outlet 8 of the final pumping stage TR to the discharge 5.

The vacuum pump 1 also comprises a valve with a through-passage 10 (also known as a "check-valve with through-passage") arranged in the discharge line 9, a Venturi-effect passage 11 passing through the valve with a through-passage 10.

According to a first embodiment depicted in FIGS. 1 to 4, the Venturi-effect passage 11 is formed in the valve 10 with a through-passage.

The Venturi-effect passage 11 allows gases to pass between the outlet 8 of the final pumping stage TR and the discharge 5. It is arranged in such a way that the axis of the Venturi-effect passage 11 and the axis of the discharge line 9 are aligned, the Venturi-effect passage and the discharge line 9 being coaxial.

The valve with a through-passage 10 is, for example, arranged at the inlet to the silencer 14 of the vacuum pump 1, the silencer 14 being positioned upstream of the discharge 5.

This valve 10 with a through-passage is able to move axially between a closed position (FIG. 1) in which it is in contact with a seat of a mouth 12 of the discharge line 9 and forces the gases to pass through the Venturi-effect passage 11, and an open position (FIG. 2) in which it is positioned away from the mouth 12 of the discharge line 9.

The Venturi-effect passage 11 is a through-duct forming a narrowing of the passage of the gases in order to obtain an "ejector" function when a motor gas is injected at the inlet 11*a*.

The ejector thus obtained operates like a small auxiliary vacuum pump, comprising no moving parts, and in which the lowering of pressure is obtained by converting the kinetic energy of an auxiliary fluid, the motor gas.

The vacuum pump 1 further comprises a motor gas injection device 13 configured to inject the motor gas, such as compressed nitrogen or compressed dry air (CDA) or another compressed neutral gas, to the inlet 11*a* of the Venturi-effect passage 11. The absolute compression pressure of the motor gas is at minimum of the order of 3 bar. The motor gas is injected at least when the valve with a through-passage 10 is in the closed position.

To do so, the motor gas injection device 13 comprises a supply line 23, one end of which bears an injection nozzle 22.

According to one embodiment depicted in FIG. 8, the injection nozzle 22 is formed of a narrowed section 26 of the supply line 23. The diameter of the narrowed section 26 is, for example, of the order of 1 millimetre. The narrowed section 26 makes it possible to achieve the desired acceleration of the motor gas in order to obtain the Venturi effect.

According to another example which has not been depicted, the injection nozzle is formed by a nozzle for example of the injector type made of hard material, such as an injector made of ruby predrilled with an injection orifice.

Figure 4:
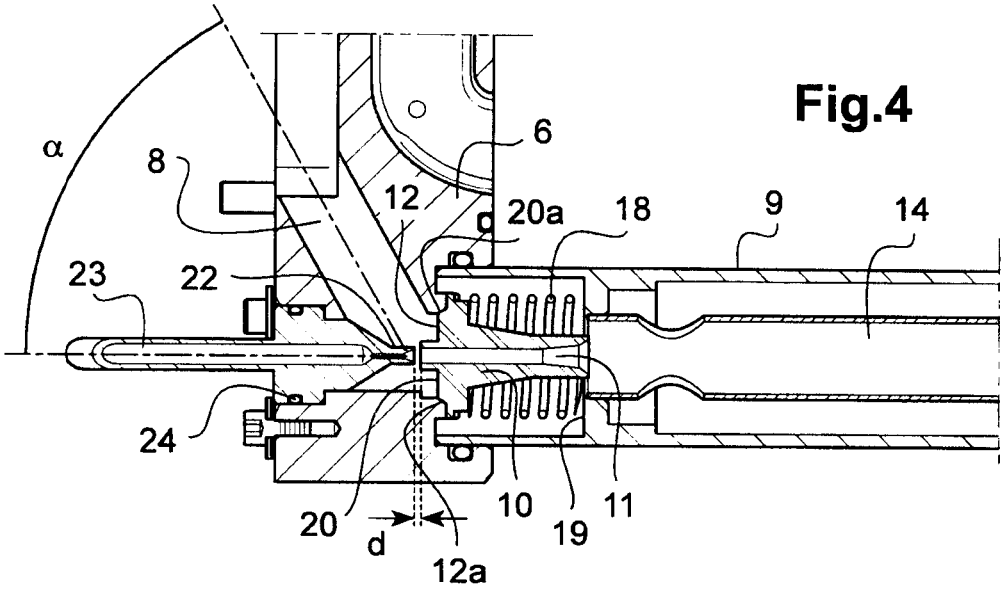
FIG. 4 depicts a partial enlarged view in cross section of the elements of the dry roughing vacuum pump of FIG. 3.

Furthermore, in the examples depicted in FIGS. 1 to 4, the motor gas injection device 13 is partially incorporated into a housing space in the pump housing 6. The injection nozzle 22 thus opens at the outlet 8 of the final discharge stage TR. A seal 24 is also interposed between the motor gas injection device 13 and the housing space in the pump housing 6, to guarantee that this pump housing is sealed (FIG. 4).

The Venturi-effect passage 11 has the shape of a jet nozzle with a narrowing.

According to one embodiment depicted in FIG. 7, the Venturi-effect passage 11 has what is referred to as a "supersonic" nozzle shape: the inlet 11*a* to the Venturi-effect passage 11, namely that side of the Venturi-effect passage 11 that communicates with the outlet 8 of the pumping stage TR, takes the form of a funnel, the neck of which is extended by the narrowed section taking the form of a cylindrical central portion 11*b*.

The cylindrical central portion 11*b* ends downstream in a flared shape 11*c* (FIGS. 4 and 7). The diameter of the cylindrical central portion of the Venturi-effect passage 11 is, for example, comprised between 2 and 10 millimetres, such as of the order of 3 millimetres for a discharge line 9 for example of the order of 25 millimetres in diameter. The total length of the Venturi-effect passage 11 is for example of the order of 20 to 30 millimetres with the length of the cylindrical central portion 11*b* of the Venturi-effect passage 11 for example being of the order of 14 to 16 millimetres. This shape of Venturi-effect passage 11 is said to be "supersonic" with a convergent first section followed by a divergent section. It makes it possible to achieve supersonic gas flow rates and to optimize the flow of the gases pumped through the Venturi-effect passage 11 while at the same time limiting pressure drops but offering a narrowing suited to generating the "Venturi effect".

The outlet of the motor gas injection device 13 is oriented to face the inlet 11*a* of the Venturi-effect passage 11 so as to inject a motor gas in a main direction aligned with the axis of the Venturi-effect passage 11.

The distance d between the outlet of the motor gas injection device 13 and the inlet 11*a* of the Venturi-effect passage 11 when the valve with a through-passage is in the closed position is small, for example comprised between 0.5 and 2 millimetres.

Furthermore, the diameter of the outlet of the motor gas injection device 13 is less than or equal to the diameter of the inlet 11*a* of the Venturi-effect passage 11.

According to another embodiment which has not been depicted, in the closed position, the outlet of the motor gas injection device 13 is received at the inlet 11*a* of the Venturi-effect passage 11, at the inlet of the cylindrical central portion 11*b*.

The outlet 8 of the final pumping stage TR and the axis of the injection nozzle 22 make an angle $\alpha$ of, for example, 0 and 90° to make the vacuum pump 1 easier to fit (FIG. 4).

The valve with a through-passage 10 is also configured to be in the open position when the outlet pressure of the final pumping stage TR is higher than a predetermined pressure threshold. More specifically, the valve with a through-passage 10 is configured to be in the open position when the pressure difference $\Delta P$ between the outlet pressure 8 of the last pumping stage TR and the pressure on the discharge side 5 is above a predetermined threshold, such as between 150 and 200 mbar for example.

For example, the valve 10 with a through-passage is urged into the closed position in which it is against the mouth 12 by an elastic return element such as a helical spring 18. In the event of an overpressure at the outlet 8 of the final discharge stage TR, the valve 10 with a through-passage is pushed back against the effect of its elastic return by the overpressure, opening the mouth 12 to the passage of gas.

According to another example which is not depicted, the valve with a through-passage is arranged vertically above the mouth. This valve with a through-passage can then be urged into the position in which it is closed against the mouth under the effect of gravity. In the event of an overpressure at the outlet 8 of the final discharge stage TR, the valve with a through-passage 10 is pushed back upwards, opening the valve 12 for the passage of gas.

Figure 5:
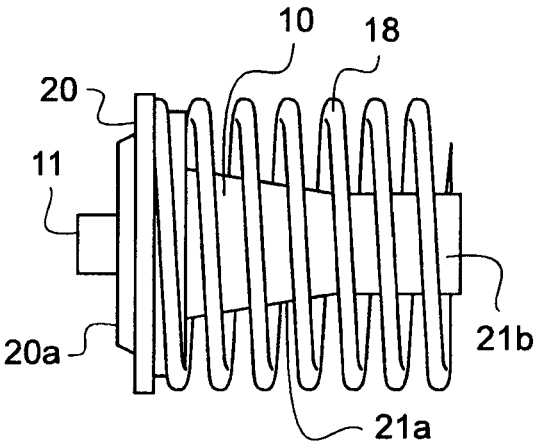
FIG. 5 depicts a perspective view of a valve with a through-passage and of a spring assembled with the valve with a through-passage of the dry roughing vacuum pump of FIG. 4.
Figure 6:
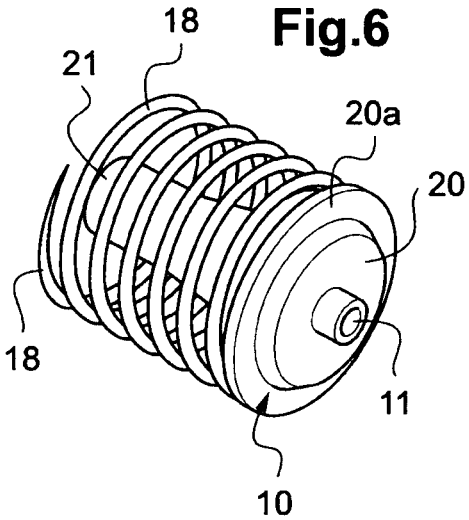
FIG. 6 depicts another view of the valve with a through-passage and of the spring of FIG. 5.

According to one embodiment better visible in FIGS. 4, 5 and 6, the valve 10 with a through-passage has a head 20 in the shape of a disc and a stem 21 extending the head 20, the stem 21 having a shape that tapers progressively and radially from the head 20.

The head 20 has a disc shape acting as a stopper: when the valve 10 with a through-passage is in the closed position, the head 20 rests on the seat formed by the mouth 12 of the Venturi-effect passage 11.

The stem 21 of the valve 10 with a through-passage is long enough to be lodged at least in part in the Venturi-effect passage 11, with a length that is optimized for ejector-type operation.

The spring 18 is interposed between the head 20 of the valve with a through-passage 10 and an annular shoulder 19 of the discharge line 9, the annular shoulder 19 being arranged downstream of the mouth 12 in the direction in which the gases are pumped. The annular shoulder 19 thus forms, for example, a device for holding the silencer 14 (FIG. 4). The valve 10 with a through-passage is thus mounted, coaxially in the spring 18, the stem 21 extending inside the latter.

Furthermore, to ensure the sealing and correct positioning of the valve 10 with a through-passage each time it returns to the closed position, the head 20 of the valve with a through-passage 10 has a guiding shape 20*a* configured to collaborate with a complementary guiding shape 12*a* belonging to the mouth 12 forming the seat for the head 20 of the valve with a through-passage 10.

For example, the guiding shapes 20*a* of the part of the head 20 in contact with the seat 12 and the complementary guiding shape 12*a* of the seat 12 have complementary frustoconical shapes (FIG. 4). According to another example which has not been depicted, these complementary guiding shapes are partially spherical. The complementary guiding shapes 12*a*, 20*a* allow the valve 10 with a through-passage to automatically centre itself in the axis of the discharge line 9 and facing the injection nozzle 22, making it possible to ensure optimal operation as an ejector using the Venturi effect.

The stem 21 has, for example, an exterior shape which progressively tapers radially 21*a* at least partially from the head 20 in order to lessen the turbulence that may be generated near it in the gaseous stream. This tapering exterior shape 21*a* also allows the flow of gases around its profile to be stabilized gradually and allows any oscillation of the valve 10 with a through-passage to be minimized.

The end 21*b* of the stem 21 has, for example, a cylindrical shape, the diameter of which being adapted to be inserted at the inlet of the silencer 14 of the vacuum pump 1 without blocking the passage but leaving an annular opening free for the gases that is compatible with a heavy flow when the valve with a through-passage 10 is in the open position. For example, the outside diameter of the cylindrical end 21*b* of the stem 21 is of the order of 8 millimetres. The outside diameter of the end 21*b* is also of the same order of magnitude as the diameter of the end of flared shape 11*c* of the Venturi-effect passage 11.

Thus, as for example depicted in FIGS. 4, 5 and 6, the stem 21 has an exterior shape which tapers 21*a*, for example as a substantially frustoconical shape from the head 20 as far as a central portion 11*b* of the Venturi-effect passage 11, extended by a cylindrical portion at the end 21*b*.

The motor gas injection device 13 may also comprise a heat exchanger 25 (FIG. 1) in contact with the pump housing 6 of the vacuum pump 1 so as to warm up the motor gas before it arrives in the supply line 23. The heat energy given off by the pump housing 6 of the vacuum pump is thus used for warming the motor gas. The dry roughing vacuum pump 1 may also comprise heating covers (not depicted) to encourage the heating up of the motor gas.

The valve 10 with a through-passage is for example made of aluminum, of stainless steel, of Ni-resist cast iron or is coated with coatings of the Ni—P, Ni—B, SiC, BN, $Al_2O_3$, $Si_3N_3$, $YtO_2$, $ZrO_2$ type which are particularly corrosion resistant and, in the case of some of them, also abrasion resistant.

In normal operation, such as in a phase in which the process chamber is in production, the stream of gases to be pumped is for example less than 100 slm.

The outlet pressure 8 of the vacuum pump is lower than the atmospheric pressure of the discharge 5, the valve 10 with a through-passage therefore being in the closed position (FIG. 1).

In this position, the head 20 of the valve 10 with a through-passage rests against the seat of the discharge line 9 which is formed by the mouth 12. At the outlet 8 from the final pumping stage TR, the gas that is to be pumped follows the Venturi-effect passage 11, through the valve with a through-passage 10 (arrows in solid line). When a motor gas is injected at the inlet 11*a* of the Venturi-effect passage 11 (arrows in dotted line), a depression is established, causing a lowering of pressure at the outlet 8 of the vacuum pump 1, through a Venturi effect. The Venturi-effect passage 11 thus forms an ejector with the motor gas injection device 13.

The motor gas can be injected permanently. As an alternative, a control unit is provided for managing the injection of motor gas according to the level of electrical power consumed by the roughing vacuum pump 1 or the state of operation of the process chamber: in production, preroughing vacuum or standby.

In the scenario illustrated in FIGS. 1 to 4 where the valve 10 with a through-passage is arranged in the discharge line 9 of the last pumping stage TR upstream of the discharge 5 at atmospheric pressure, the absolute pressure obtained is for example of the order of 100 to 400 mbar. This depression generates a lowering of the electrical power consumption of the vacuum pump 1 of the order of 30 to 70%.

In the event of a significant flow of gas to be removed, the difference in pressure $\Delta P$ between the pressure at the outlet 8 of the final pumping stage TR and the pressure at the discharge 5 becomes higher than a predetermined pressure threshold. This surplus of gas, in excess of 100 slm, such as of the order of 500 to 600 slm occurs for example when roughing a vacuum in the chamber connected to the vacuum pump 1 or when starting the vacuum pump 1, i.e. when pumping gases from atmospheric pressure.

This overpressure pushes back the head 20 of the valve 10 with a through-passage away from the mouth 12, against the action of its elastic return, opening the valve 10 with a through-passage 10. The gas that is to be pumped therefore follows the discharge circuit, passing into the mouth 12 and then between the discharge line 9 and the valve 10 with a through-passage (arrows in solid line in FIG. 2). Thus the surplus gas does not cause an overpressure at the outlet 8 of the final pumping stage, but can be absorbed by the vacuum pump 1.

The valve 10 with a through-passage forms both an ejector when in the closed position to generate the Venturi effect when a motor gas is injected upstream of the Venturi-effect passage 11, and a discharge circuit when in the open position in order to bypass the Venturi-effect passage.

The gases thus have an automatic discharge circuit created by the moving of the valve with a through-passage into the open position in the event of high flows to be pumped, so that the narrowing formed by the Venturi-effect passage 11 does not form an obstacle to pumping.

There is therefore no need to machine a parallel bypass circuit in the pump housing 6 and/or to arrange an external bypass circuit with controlled valve, and this means that the vacuum pump is simplified, more compact, and also more robust and easier to maintain.

An absolute pressure at the outlet of the final pumping stage of the order of 100 to 400 mbar is obtained, generating a reduction in the electrical power consumption without adversely affecting the pumping performance (flow of gas as a function of pressure).

The lowering of electrical power consumption also leads to lowering of the temperature of the pump housing 6 so that the amount of heat energy to be removed is reduced and may lead to a reduction in the cooling water consumption.

Furthermore, the lowering of the pressure at the outlet of the final pumping stage TR allows the pumping conditions to be kept away from the flammability and explosion limits and makes it possible to reduce the partial pressures of condensable and/or corrosive species, significantly reducing the risks of corrosion of materials of the vacuum pump and the risks of plugging with condensate.

The lowering of the pressure at the outlet of the final pumping stage TR of the vacuum pump 1 also reduces the noise level of the vacuum pump. This is because the depression lowers the intensity of the low-frequency pulsations of the final pumping stage TR.

Furthermore, the assembly forming the valve and the ejector is thus arranged at the heart of the vacuum pump 1 and can therefore benefit from the high temperature of the pump housing 6 in operation in order to be warmed. As a result, by warming the valve 10 with a through-passage notably by conduction from the heated pump housing 6, the risks of plugging that may occur in the Venturi-effect passage 11, induced by the cooling of condensable gases caused by the expansion of the gas in the Venturi-effect passage 11 are reduced.

According to another exemplary embodiment depicted in FIG. 9, the discharge line 9 extends as far as an end connected to a pumped gas treatment device (or "scrubber" or "gas abatement"). The gas treatment devices are generally connected to the discharge of the vacuum pumps, to remove contamination from the pumped gases when such gases are toxic.

The valve 10 with a through-passage is arranged in this end of the discharge line 9 near the inlet to the pumped gases treatment device.

The motor gas injection device 13 is partially housed in the discharge line 9 near the valve 10 with a through-passage in order to perform the ejector and depression-inducing function. The injection nozzle 22 thus opens at the outlet 8 of the final discharge stage TR, after the silencer of the vacuum pump 1.

The discharge line 9 is therefore kept under low pressure from the gas outlet 8 of the vacuum pump 1 as far as the inlet of the gas treatment device, a run which may represent several metres of piping. The fact that the discharge line 9 is kept under low pressure means that condensable gaseous species can be kept in gaseous form, and this may in some instances make it possible to avoid the need to heat the discharge line 9.

According to a second embodiment depicted in FIGS. 10*a*, 10*b*, 11*a* and 11*b*, the motor gas injection device 13 is secured to the valve 10 with a through-passage in which the Venturi-effect passage 11 is formed. At least one inlet orifice 28 of the pumped gases is formed between the outlet of the motor gas injection device 13 and the inlet 11*a* of the Venturi-effect passage 11.

The motor gas injection device 13 is for example fixed to the valve 10 with a through-passage by a connection 27 having at least one inlet orifice 28 for the pumped gases and maintaining a predetermined distance d, for example comprised between 0.5 and 2 millimetres, between the outlet of the motor gas injection device 13 and the inlet 11*a* of the Venturi-effect passage 11.

The connection 27 is, for example, formed of a cylinder provided with peripheral longitudinal ports forming the inlet orifices 28 for the pumped gases coming from the outlet 8 of the final pumping stage TR.

Figure 10A:
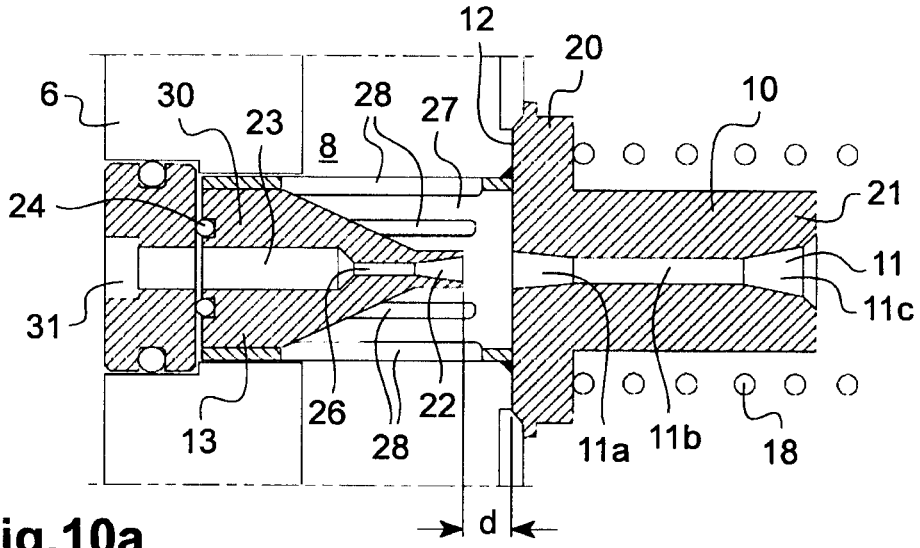
FIG. 10*a* depicts a first alternative form of a second embodiment of the valve-ejector assembly.

As may be seen from the example illustrated in FIG. 10*a*, a seal 24 may be interposed between the base 30 of the gas injection device 13 and a corresponding housing space formed in the pump housing 6. A duct 31 is formed in the bottom of the housing space in the pump housing 6 leading toward a motor gas supply (not depicted).

The housing space in the pump housing 6 is dimensioned so that, in the open position, the base 30 of the gas injection device 13 remains centred in the housing space, to make it easier to guide the movement of the assembly consisting of the valve with a through-passage and the motor gas injection device 13.

Figure 10B:
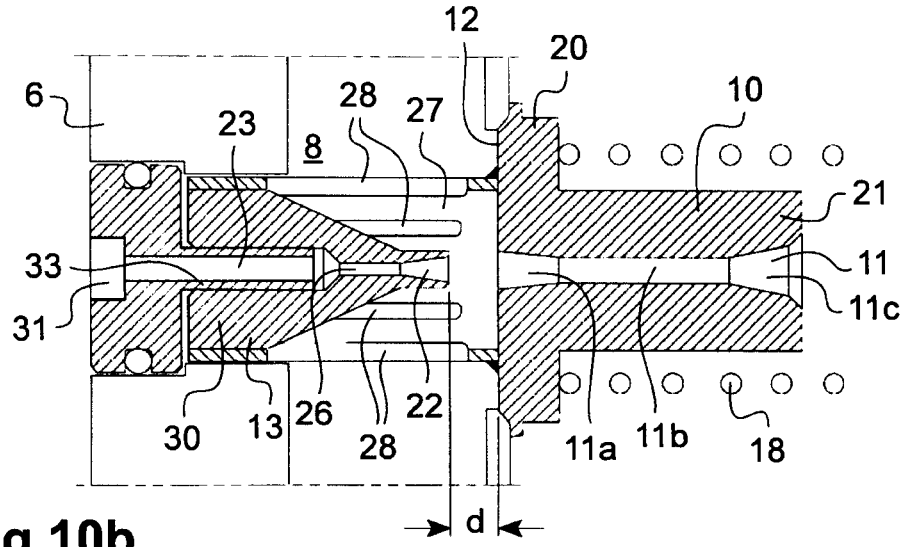
FIG. 10*b* depicts a second alternative form of the second embodiment of the valve-ejector assembly.

To make it easier to guide and self-centre the gas injection device 13 in the housing space in the pump housing 6, provision may also be made for the base 30 of the gas injection device 13 and the housing space to have complementary guiding shapes. The duct 31 of the housing space has, for example, a guide tube 34 around the supply line 23, and configured to fit into a corresponding cavity in the base 30 of the gas injection device 13 (FIGS. 10*b* and 11*b*). The guide tube 34 provides guidance and self-centring of the gas injection device 13 and also makes it possible to limit the extent to which the supply line 23 is exposed to the high supply pressure, generally of the order of 3 and 7 bar. In addition, the guide tube 34 makes it possible to limit leaks of motor gas by reducing the functional clearance (achieving a sliding fit) and therefore without the use of a seal, used as a piston.

In the closed position, the valve 10 with a through-passage is in contact with the seat of the mouth 12 of the discharge line 9, and this forces the pumped gases through the Venturi-effect passage 11. The base 30 of the motor gas injection device 13 is centred in the housing space of the pump housing 6. The supply line 23 of the motor gas injection device 13 therefore communicates with the duct 31 formed in the bottom of the housing space of the pump housing 6.

In the open position, it is the assembly consisting of the valve 10 with a through-passage and of the motor gas injection device 13 which is moved away from the mouth 12 of the discharge line 9.

Joined together in this way, the distance between the injection nozzle 22 and the Venturi-effect passage 11 remains fixed, making it possible to ensure correct centring and correct positioning between the valve with a through-passage and the motor gas injection device.

Figure 11A:
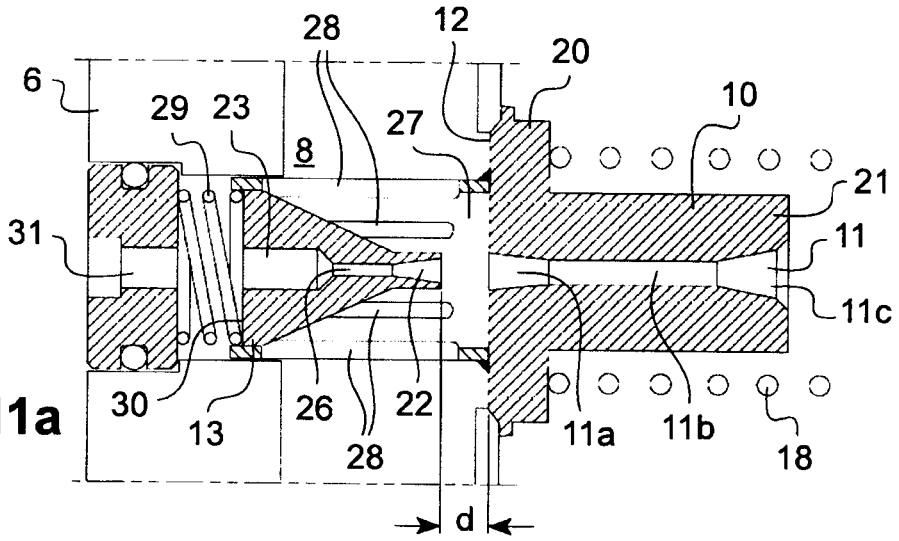
FIG. 11*a* depicts a third alternative form of the second embodiment of the valve-ejector assembly.
Figure 11B:
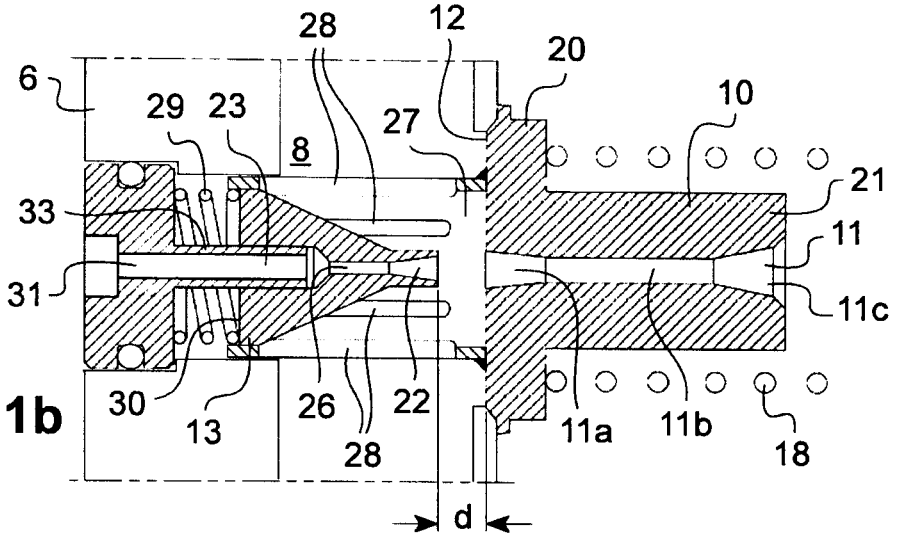
FIG. 11*b* depicts a fourth alternative form of the second embodiment of the valve-ejector assembly.

The alternative forms of embodiment illustrated in FIGS. 11*a* and 11*b* differ from FIGS. 10*a* and 10*b* in that an elastic return member 29 is arranged in the housing space of the vacuum pump body 6. The elastic return member, such as a coil spring, is interposed between the vacuum pump housing 6 and the base 30 of the motor gas injection device 13. It urges the valve 10 with a through-passage into the open position. This then improves the guidance and positioning of the motor gas injection device 13.

Figure 12:
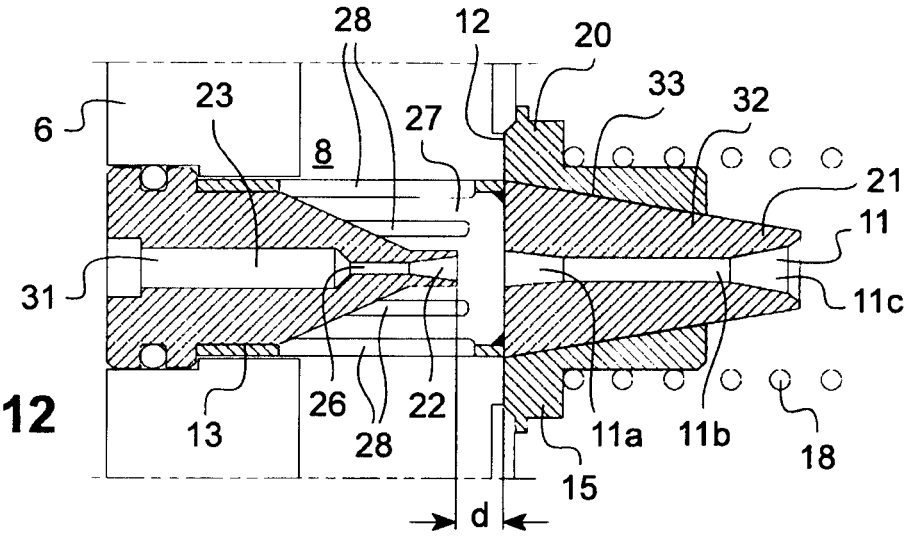
FIG. 12 depicts a third embodiment of the valve-ejector assembly.

According to a third embodiment depicted in FIG. 12, the valve 15 with a through-passage has a disc-shaped head 20 in which an opening is formed, but does not have a stem in which to accommodate the Venturi-effect passage.

The Venturi-effect passage 11 is formed in a protrusion 32 secured to the motor gas injection device 13, at least one inlet orifice 28 for the pumped gases being formed between the outlet of the motor gas injection device 13 and the inlet 11*a* of the Venturi-effect passage 11. The protrusion 32 is arranged with an additional seat 33 formed in an opening of the valve 15 with a through-passage.

The protrusion 32 is, for example, fixed to the motor gas injection device 13 by a connection 27 like the one described hereinabove, maintaining a predetermined distance d, for example comprised between 0.5 and 2 millimetres, between the outlet of the motor gas injection device 13 and the inlet 11*a* of the Venturi-effect passage 11.

In the closed position, the head 20 of the valve 15 with a through-passage is in contact with the seat of the mouth 12 of the discharge line 9. The protrusion 32 is in contact either continually or with a minimum clearance ε, with the bearing zone between the additional seat 33 and the protrusion 32 so that the pressure drop across the clearance ε is sufficient to limit the leakage flow rate of gas in this bearing zone. This minimized leakage gas flow rate allows acceptable operation of the ejector upstream of the opening of the valve 15 with a through-passage, and this forces the gases to pass through the Venturi-effect passage 11 formed in the protrusion 32.

Two levels of sealing are therefore needed for guiding the pumped gases from the outlet 8 of the final pumping stage TR to the Venturi-effect passage 11.

To make the self-centring of the valve 15 with a through-passage with respect to the protrusion 32 easier, provision is for example made for the protrusion 32 and the additional seat 33 to have complementary guiding shapes, such as frustoconical shapes as depicted in FIG. 12. Further, the frustoconical exterior shape of the protrusion 32, progressively tapering radially means that turbulence of the gaseous flow can be reduced.

In the open position, the protuberance 32 and the motor gas injection device 33 remain fixed and it is the valve 15 with a through-passage that is moved away from the mouth 12 of the discharge line 9.

Thus, the distance between the outlet of the motor gas injection device 13 and the inlet 11*a* of the Venturi-effect passage 11 remains fixed. There is therefore certainty that correct centring and correct positioning of the valve 15 with a through-passage with respect to the motor gas injection for obtaining the Venturi effect will be ensured.

It will therefore be understood that for the same pumping performance, the dry roughing vacuum pump offers a lower electrical power consumption, is therefore more economical with energy and also with cooling water, and offers reduced risks of plugging and corrosion.

The invention claimed is:

1. Dry roughing vacuum pump comprising:

at least one pumping stage for pumping gases from an inlet to an outlet, said at least one pumping stage including two rotors rotating inside a pump housing in opposite directions without mechanical contact between the rotors and the pump housing, a discharge line connected to the outlet of a last pumping stage of said at least one pumping stage, characterized in that a valve with a through-passage is arranged in the discharge line, the valve with a through-passage being able to move between:

a closed position in which the said valve with a through-passage is in contact with a seat of a mouth of the discharge line and forces the gases to pass through a Venturi-effect passage that passes through the valve with a through-passage, and an open position in which the valve with a through-passage is moved away from the mouth of the discharge line, forming a discharge circuit to bypass the Venturi-effect passage, the valve with a through-passage being in the open position when the outlet pressure of the at least one pumping stage is above a predetermined pressure threshold, the vacuum pump further including a device for injecting motor gas which is configured to inject a motor gas into the inlet of the Venturi-effect passage so that that in the closed position the Venturi-effect passage forms an ejector with the motor-gas injection device when a motor gas is injected into the inlet of the Venturi-effect passage, characterized in that the Venturi-effect passage is in the shape of and nozzle with a narrowing, and characterized in that the inlet of the nozzle is shaped like a funnel, the neck of which is extended by a cylindrical central portion and ends in a flared shape.

2. A vacuum pump according to claim 1, characterized in that the Venturi-effect passage is formed in the valve with a through-passage.

3. A vacuum pump according to claim 2, characterized in that the device for injecting the motor gas is secured to the valve with a through-passage with a fixed predetermined distance (d) between the outlet of the motor gas injection device and the inlet of the Venturi-effect passage, at least one pumped gases inlet orifice being formed between the outlet of the motor gas injection device and the inlet of the Venturi-effect passage.

4. A vacuum pump according to claim 3, characterized in that it comprises an elastic return member interposed between the vacuum pump body and the motor gas injection device to urge the valve with a through-passage into the open position.

5. A vacuum pump according to claim 1, characterized in that the Venturi-effect passage is formed in a protrusion secured to the motor gas injection device with a fixed predetermined distance (d) between the outlet of the motor gas injection device and the inlet of the Venturi-effect passage, at least one pumped gases inlet orifice being formed between the outlet of the motor gas injection device and the inlet of the Venturi-effect passage, the protrusion collaborating with an additional seat formed in an opening in the valve with a through-passage.

6. A vacuum pump according to claim 5, characterized in that the protrusion and the additional seat has frustoconical or partially spherical complementary guiding shapes.

7. A vacuum pump according to claim 1, characterized in that the motor gas injection device is partially incorporated into the pump body of the vacuum pump.

8. A vacuum pump according to claim 7, characterized in that the valve with a through-passage is positioned at the inlet to a silencer of the vacuum pump.

9. A vacuum pump according to claim 1, characterized in that the valve with a through-passage is arranged at one end of the discharge line, the end being connected to a pumped gases treatment device.

10. A vacuum pump according to claim 1, characterized in that the valve with a through-passage has a head having a guide shape configured to collaborate with a complementary guiding shape belonging to the mouth.

11. A vacuum pump according to claim 10, characterized in that the complementary guiding shapes are frustoconical or partially spherical.

12. A vacuum pump according to claim 1, characterized in that the motor gas injection device comprises a supply line, one end of which bears an injection nozzle, the motor gas injection axis and the axis of the Venturi-effect passage being aligned.

13. A vacuum pump according to claim 1, characterized in that it comprises an elastic return element urging the valve with a through-passage into the position in which it is closed against the valve.

14. A vacuum pump according to claim 1, characterized in that the valve with a through-passage is arranged vertically above the mouth.

15. A vacuum pump according to claim 1, wherein the motor gas comprises one of compressed nitrogen or compressed dry air (CDA) or another compressed neutral gas.

16. A vacuum pump according to claim 1, wherein gases passing through said at least one pumping stage pass through said Venturi-effect passage together with said motor gas.

* * * * *